US009962948B1

(12) United States Patent
Bernard et al.

(10) Patent No.: US 9,962,948 B1
(45) Date of Patent: May 8, 2018

(54) FLUID DELIVERY DEVICES

(71) Applicant: FUNAI ELECTRIC CO., LTD, Osaka (JP)

(72) Inventors: David L. Bernard, Lexington, KY (US); Tim Frasure, Lexington, KY (US); Sean T. Weaver, Lexington, KY (US); Andrew L. McNees, Lexington, KY (US); David C. Graham, Lexington, KY (US)

(73) Assignee: Funai Electric Co., Ltd. (JP)

( * ) Notice: Subject to any disclaimer, the term of this patent is extended or adjusted under 35 U.S.C. 154(b) by 0 days. days.

(21) Appl. No.: 15/388,409

(22) Filed: Dec. 22, 2016

(51) Int. Cl.
*B41J 2/175* (2006.01)

(52) U.S. Cl.
CPC ..... *B41J 2/17553* (2013.01)

(58) Field of Classification Search
CPC .... B41J 2/17553; B41J 2/175; B41J 2/17503; B41J 2/17513; B41J 2/17523
See application file for complete search history.

(56) References Cited

U.S. PATENT DOCUMENTS

| | | | | |
|---|---|---|---|---|
| 5,742,308 | A | 4/1998 | Cowger | |
| 6,302,533 | B1 * | 10/2001 | Shimomura | B41J 2/17513 347/86 |
| 6,390,612 | B1 | 5/2002 | Kotaki et al. | |
| 6,709,092 | B2 | 3/2004 | Hayashi et al. | |
| 6,796,645 | B2 | 9/2004 | Hayashi et al. | |
| 6,874,875 | B1 | 4/2005 | Anderson et al. | |

FOREIGN PATENT DOCUMENTS

JP 11-227224 * 8/1999

* cited by examiner

*Primary Examiner* — Juanita D Jackson
(74) *Attorney, Agent, or Firm* — Luedeka Neely Group, PC

(57) ABSTRACT

A fluidic delivery device having improved volumetric efficiency. The device includes a fluid container having a standpipe at a lower end of the container and open areas located below a fluid entrance end of the standpipe; a first fluid permeable body located in the fluid container above the fluid entrance end of the standpipe; and one or more second fluid permeable bodies located in the open areas of the fluid container below the first fluid permeable body and below the fluid entrance end of the standpipe.

11 Claims, 4 Drawing Sheets

FLUID DELIVERY DEVICES

FIELD

This disclosure relates generally to apparatus for delivering fluid. More particularly, this disclosure relates to fluid delivery devices having improved efficiency in delivering fluid with reduced wastage of fluid.

BACKGROUND

Improvement is desired in the field of fluidic structures of the type used to dispense fluid from a storage supply. Inkjet printheads are one example of fluidic structures that operate by dispensing fluid from a fluid supply.

Conventional fluidic structures for dispensing fluid from a fluid supply desire improvement in their ability to more completely utilize the fluids they are designed to dispense and reduce wasting of fluid. For example, conventional devices typically cannot dispense more than about 90 percent of the stored fluid, leaving the undispensed fluid in the device once the device has exhausted its functional life.

This undispensed fluid represents a significant waste of fluid and also disadvantageously affects the size of construction of the device. For example, as desired fluid levels in such devices increase, the fluid volumetric efficiency of the device becomes of greater concern. An inefficient device requires a larger volume of fluid, which requires a larger device, which impacts the cost. Also, the increased mass of a larger device can also negatively affect the fragility during shipping and handling, as well as shipping costs for gross shipment of devices.

Accordingly, what is desired are fluidic devices that promote improved efficiency of dispensing fluid. Improved efficiency will result in more of the fluid stored in the device being dispensed. This will reduce the amount of fluid that is wasted and remains in the device once the device has completed its service life.

SUMMARY

The present disclosure relates to fluid delivery devices having improved volumetric efficiency.

In one aspect, the devices include a fluid container having a standpipe at a lower end of the container and open areas located below a fluid entrance end of the standpipe. A first fluid permeable body is located in the fluid container above the fluid entrance end of the standpipe. A plurality of second fluid permeable bodies are located in the open areas of the fluid container below the first fluid permeable body and below the fluid entrance end of the standpipe.

Structures according to the disclosure reduce the volume of the device and reduce fluid waste as compared to conventional structures.

In yet a further aspect of the disclosure, there is provided a method of increasing fluidic delivery device volumetric efficiency of a fluidic delivery device having a fluid container including a standpipe at a lower end of the container and open areas located below a fluid entrance end of the standpipe.

The method includes the steps of: providing and locating a first fluid permeable body in the fluid container above the fluid entrance end of the standpipe; and providing and locating a plurality of second fluid permeable bodies in the open areas of the fluid container below the first fluid permeable body and below the fluid entrance end of the standpipe. The first and the second fluid permeable bodies cooperate to promote voiding of the fluid from the open areas during use of the fluidic delivery device.

BRIEF DESCRIPTION OF THE DRAWINGS

Further advantages of the disclosure are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
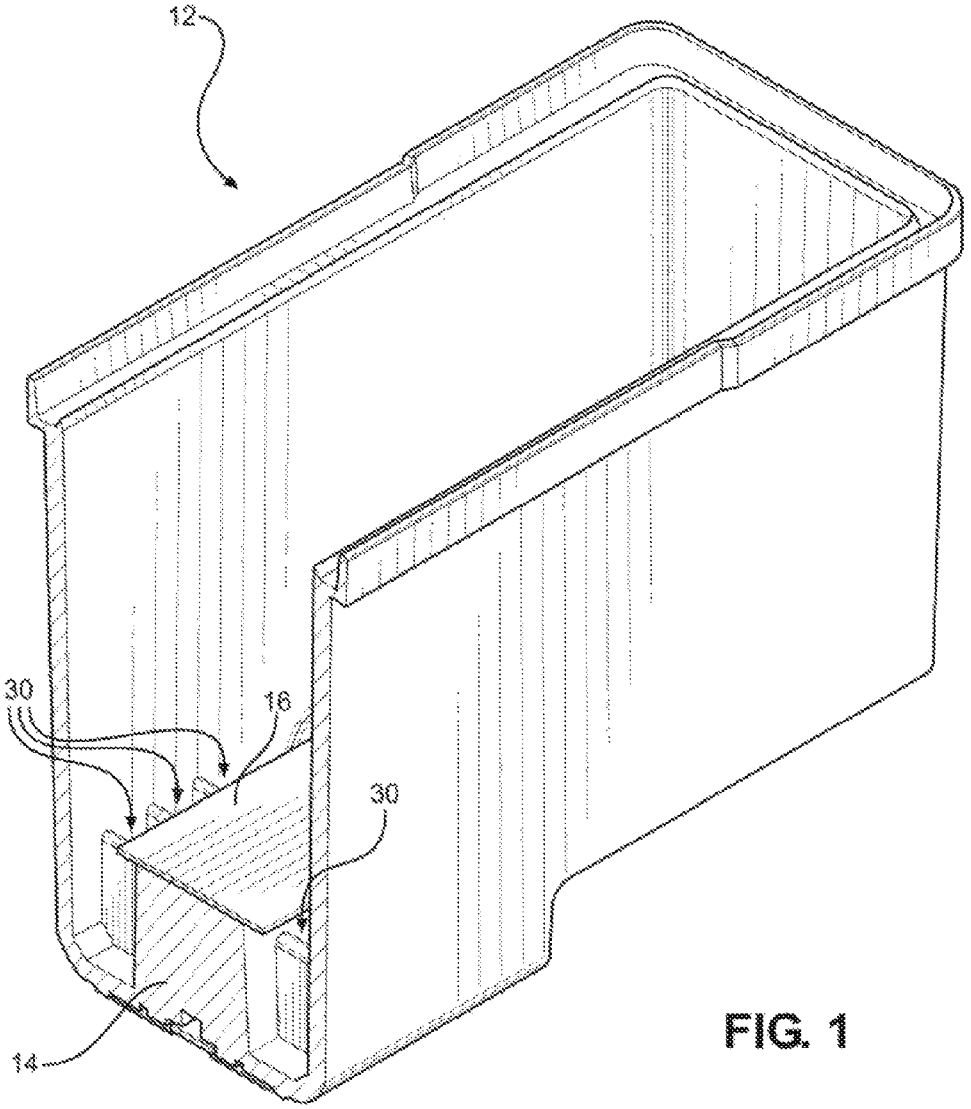
FIG. 1 depicts a portion of a fluid container.

The disclosure relates to fluidic devices that promote improved efficiency of dispensing fluid. The devices reduce the amount of fluid that is wasted and remains in the device once it has completed its service life. The terms "above" and "below", as used herein, relate to positions as depicted in the drawings and are not necessarily related to actual positions when the fluidic device is in use.

With reference to FIGS. 1-4, there is shown components of a fluid ejection device 10 according to the disclosure. In one embodiment, the fluid ejection device is configured as a printhead for delivering ink as the fluid. It will be understood that the fluid ejection device may be configured for delivery of fluids other than ink, and for other purposes.

Figure 3:
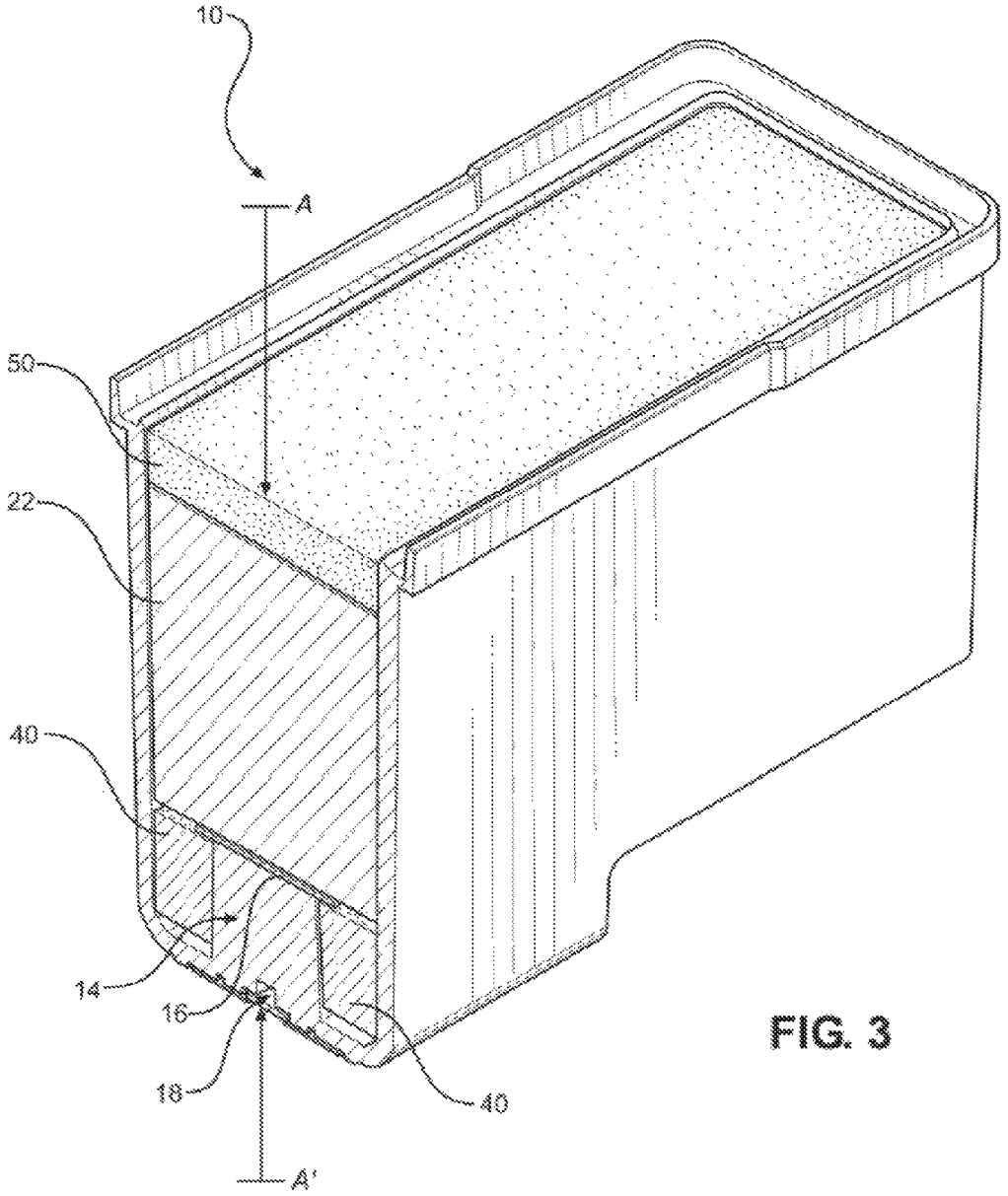
FIG. 3 shows assembly of the fluid ejection device of FIG. 2.
Figure 4:
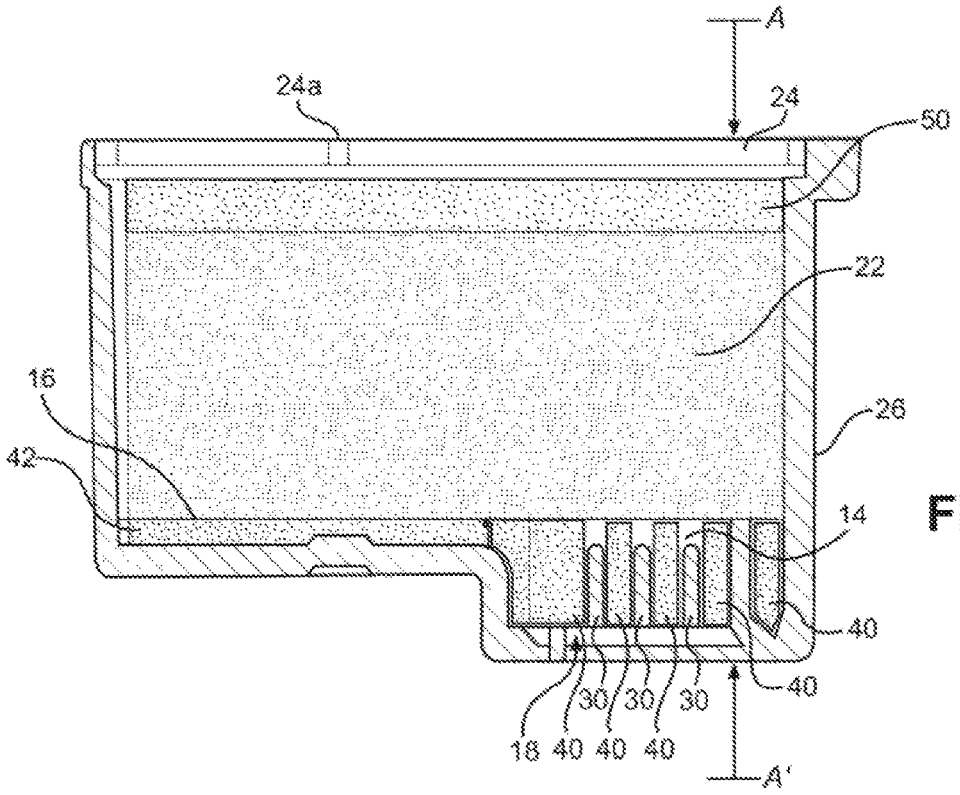
FIG. 4 is a cross-sectional side view of the fluid ejection device taken along line A-A' of FIG. 3.
Figure 5:
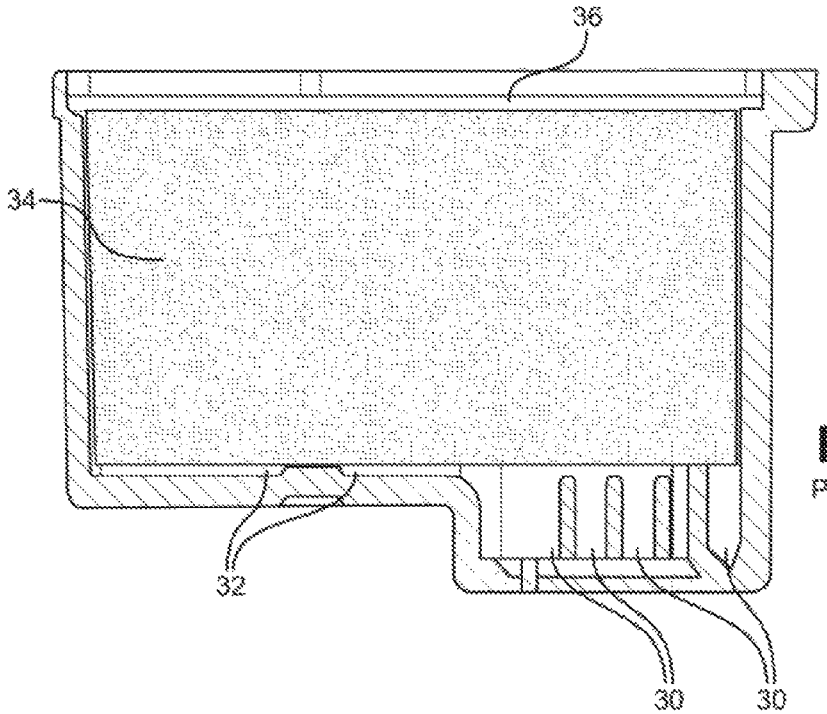
FIG. 5 PRIOR ART
FIG. 5 is a cross-sectional side view of a prior art fluid container and fluid ejection device over which devices according to the disclosure have improved volumetric efficiency.

A prior art device is shown in FIG. 5 over which the fluid container 12 of FIGS. 1-4 is an improvement. The device of FIG. 5 is discussed in more detail below to show the differences and improvements provided by the fluid container 12 according to the disclosure.

The device 10 according to the disclosure includes a fluid container 12 (FIG. 1) having a standpipe 14 located in a lower nose portion of the fluid container 12. Fluid from the container 12 travels through a filter 16 located over a top portion of the standpipe 14 to an outlet 18 located at the bottom of the standpipe 12. A fluid ejector may be located adjacent to and in flow communication with the outlet 18 to selectively eject fluid from the device 10. The fluid may be a vaporizable fluid and the fluid ejector may be, for example, a fluid vaporization heater. Electrical connections and logic circuits are integrated onto the device 10 to control and operate the device, and to otherwise control the transfer of fluid to and the operation of the fluid ejector.

Figure 2:
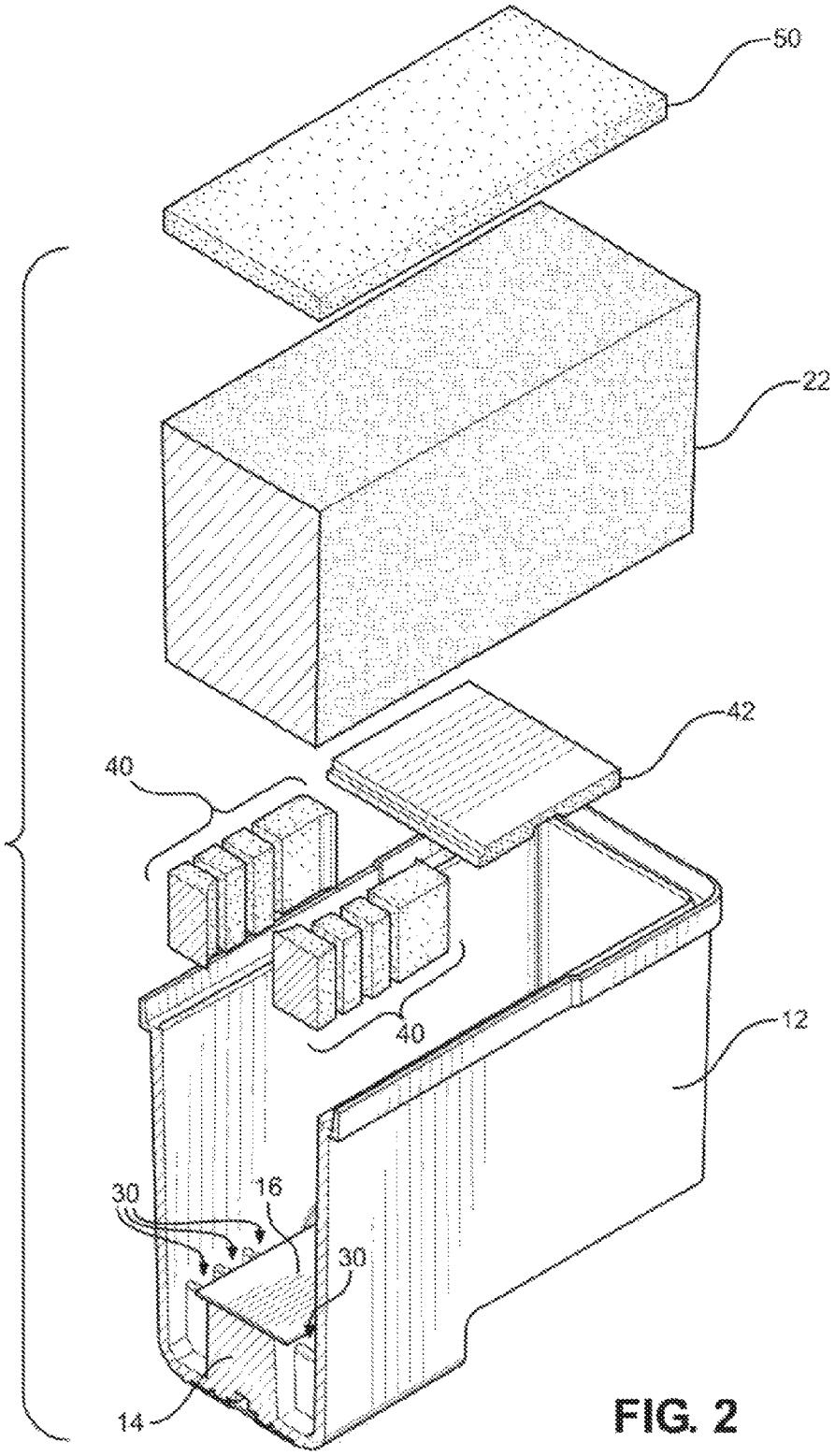
FIG. 2 is an exploded view of a fluid ejection device according to the disclosure incorporating the fluid container of FIG. 1.

A major compressible fluid permeable body 22 is located within and occupies a majority of the fluid container 12. The fluid permeable body 22 is desirably a hydrophilic foam made from melamine. In use of the device 10, fluid travels through the permeable body 22 to the filter 16, and through the filter 16 to the standpipe 14 and then to the outlet 18 for ejection by the ejector 20. A top or other cover 24 having a vent 24*a* is applied to the reservoir 12 (FIG. 4) and sealed. The fluid container 12 as shown in FIGS. 1-3 has a front wall 26 removed.

As will be observed, the fluid container 12 has void areas 30 lateral to the standpipe 14 and below the fluid permeable body 22 and the filter 16. The fluid container 12 also has one or more depressions 32 located behind and below the filter 16. Conventionally, as shown in FIG. 5, only a single fluid permeable body 34 is located in the fluid container 12. Typically, this single body 34 corresponds in location and size to the fluid permeable body 22. However, it is distinguishable from the fluid permeable body 22 of the present disclosure in that the single body 34 is made of a hydrophobic material and must be severely compressed to maintain adequate back pressure within the device to prevent drooling or leakage of fluid.

As noted above, the fluid permeable body 22 utilized in accordance with the disclosure is a hydrophilic material. Hydrophobic foams are conventionally used as they are desirable for not absorbing water from the air, and hydrophilic foams have in the past been considered undesirable, especially for the major foam component. As explained below, structures according to the disclosure obviate this concern and it has been discovered that such structures may utilize hydrophilic foams.

As will also be noted in FIG. 5, the single body 34 as utilized in the prior art does not extend into the depressions 32. As will also be observed, an air space 36 is located above the single body 34. Conventionally, the void areas 30 and the depressions 32 fill with fluid and serve to retain fluid that cannot be ejected from the device 10. FIG. 5 depicts such a conventional prior art device.

In accordance with the disclosure, and as shown in FIGS. 2-4, the device 10 advantageously also includes a plurality of minor compressible fluid permeable bodies 40 located within to substantially fill the void areas 30 adjacent to the standpipe 14 and below the filter 16 so as to underlie and contact the fluid permeable body 22. The fluid permeable bodies 40 are desirably made of a hydrophobic material to wick or otherwise motivate the fluid to travel toward the fluid permeable body 22 which is positioned to feed the fluid to the standpipe 14 for ejection from the device.

The device 10 also advantageously includes one or more additional compressible fluid permeable bodies 42 located within the depressions 32 of the fluid container 12. The fluid permeable body or bodies 42 thus underlie and contact the fluid permeable body 22. The fluid permeable bodies 42 are desirably made of a hydrophobic material to wick or otherwise motivate the fluid toward the fluid permeable body 22 which is positioned to feed the fluid to the standpipe 14 for ejection from the device.

It will be understood that the fluid must be maintained in the fluid container 12 at a negative or back pressure. The back pressure must be controlled to be sufficient to prevent the fluid from drooling or escaping from device 10. However, the back pressure must also be low enough such that excess air is not drawn into the device 10. Conventionally, this was accomplished by severe compression of the single body 34, as noted above.

It has been discovered that the use of the permeable bodies 22, 40, and 42 as described herein advantageously enables the device 10 receive and retain the fluid at an appropriate back pressure with only light compression applied to the major permeable body 22. Accordingly, once assembled, the device 10 is primed to apply a slight negative pressure to the interior of the device 10, which negative or back pressure is maintained by interaction between the permeable bodies 22, 40, and 42 and the fluid.

During use of the device 10, fluid is ejected and the volume of fluid in the device 10 reduces. When the device 10 has been operated to the extent that the permeable body 22 is no longer able to function to provide the required feed of fluid for desired operation of the device 10. At this point, the device 10 has essentially reached the end of its service life and cannot eject fluid in a reliable manner.

In the conventional device shown in FIG. 5, it will be appreciated that when the device has reached the end of its useful service life, the void areas 30 and the depressions 32 remain substantially filled with fluid, representing a significant amount of fluid remaining in the device.

In contrast, the additional permeable bodies 40 and 42 in the void areas 30 and the depressions 32 serve to evacuate fluid from these locations and cooperate with the permeable body 22 to supply such fluid to the permeable body 22 so that it may be ejected from the device 10. Thus, while the permeable bodies 40 and 42 will not be devoid of fluid, it will be appreciated that the volume of residual fluid in the permeable bodies 40 and 42 is substantially less than the amount of fluid remaining in the void areas 30 and the depressions 32 of conventional devices. Thus, the volumetric efficiency of the device 10 exceeds that of conventional devices, such as the conventional device of FIG. 5.

Accordingly, the structure, placement, and composition of the fluid permeable bodies 40 and 42 are configured to cooperate to minimize the amount of fluid in the device 10 that is not dispensed during the useful service life of the device. In broad overview, this is accomplished by configuring and placing the bodies 40 and 42 at locations so that they operate to reduce the amount of unoccupied void areas where fluid can accumulate, and to transfer fluid from such areas so that they may be ejected from the device. Thus, it has been observed that structures according to the disclosure result in improved efficiency, with reduced fluid waste as compared to conventional structures.

In addition to these advantages, the device 10 may also be configured for improved shipping and to increase fluid content of the device 10. As shown in the conventional device of FIG. 5, the air space 36 is located above the single body 34. With reference to the device 10 of the disclosure, and as best seen in FIG. 4, a capping compressible fluid permeable body 50 located above the fluid permeable body 22 and below the cover 24 in a location corresponding to that of the air space 36.

The capping fluid permeable body 50 is desirably made of a hydrophobic material to wick or otherwise motivate the fluid toward the fluid permeable body 22. Incorporating the body 50 enables the container 12 to be more fully filled than conventional devices which maintain air in the space 36 to avoid leakage as may occur during shipping. Also, the hydrophobic material for the body 50 is desirable to deter the travel of moisture from air entering through the vent **24*a* from reaching the hydrophilic fluid permeable body 22**. This also advantageously facilitates the use of a hydrophilic foam for the major foam component.

Thus, in combination, the utilization of a hydrophilic fluid permeable body for the majority of the fluid space, in combination with hydrophobic fluid permeable bodies in conventionally void areas, has been observed to provide improved volumetric efficiency. In addition, such structures enable more fluid to be contained by the device as compared to a conventional device of the same volume.

The foregoing description of preferred embodiments for this disclosure has been presented for purposes of illustration and description. The description and embodiments are not intended to be exhaustive or to limit the disclosure to the precise forms disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A fluidic delivery device having improved volumetric efficiency, comprising:

a fluid container having a standpipe at a lower end of the container and open areas located below a fluid entrance end of the standpipe;

a first fluid permeable body located in the fluid container above the fluid entrance end of the standpipe; and a plurality of second fluid permeable bodies located in the open areas of the fluid container below the first fluid permeable body and below the fluid entrance end of the standpipe.

2. The device of claim 1, wherein the first and the second fluid permeable bodies cooperate to promote voiding of the fluid from the open areas during use of the fluidic delivery device.

3. The device of claim 1, wherein the first fluid permeable body is hydrophilic.

4. The device of claim 3, wherein the hydrophilic first fluid permeable body comprises a hydrophilic foam made from melamine.

5. The device of claim 1, wherein second fluid permeable bodies are hydrophobic.

6. The device of claim 1, wherein the first and the second fluid permeable bodies comprise foam bodies.

7. The device of claim 1, further comprising a capping fluid permeable body located above the first fluid permeable body.

8. A method of increasing fluidic delivery device volumetric efficiency of a fluidic delivery device having a fluid container including a standpipe at a lower end of the container and open areas located below a fluid entrance end of the standpipe, the method comprising the steps of: providing and locating a first fluid permeable body in the fluid container above the fluid entrance end of the standpipe; and providing and locating a plurality of second fluid permeable bodies in the open areas of the fluid container below the first fluid permeable body and below the fluid entrance end of the standpipe, wherein the first and the second fluid permeable bodies cooperate to promote voiding of the fluid from the open areas during use of the fluidic delivery device.

9. The method of claim 8, wherein the first fluid permeable body is hydrophilic.

10. The method of claim 8, wherein the second fluid permeable bodies are hydrophobic.

11. The method of claim 8, further comprising the step of locating a capping fluid permeable body located above the first fluid permeable body.

* * * * *